US008831466B2

(12) United States Patent
Fujita et al.

(10) Patent No.: US 8,831,466 B2
(45) Date of Patent: Sep. 9, 2014

(54) IMAGE FORMING APPARATUS

(75) Inventors: Junpei Fujita, Kanagawa (JP); Ryuuichi Mimbu, Kanagawa (JP); Kenji Sengoku, Kanagawa (JP); Osamu Ichihashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 237 days.

(21) Appl. No.: 13/369,805

(22) Filed: Feb. 9, 2012

(65) Prior Publication Data

US 2012/0224879 A1 Sep. 6, 2012

(30) Foreign Application Priority Data

Mar. 2, 2011 (JP) ..... 2011-045459

(51) Int. Cl.
*G03G 21/20* (2006.01)
*G03G 15/16* (2006.01)
*G03G 15/01* (2006.01)

(52) U.S. Cl.
CPC ..... *G03G 15/161* (2013.01); *G03G 2215/0129* (2013.01); *G03G 15/162* (2013.01); *G03G 15/0189* (2013.01)
USPC ..... 399/94; 399/107; 399/312; 399/303

(58) Field of Classification Search
CPC ..... G03G 15/2053; G03G 15/2064; G03G 15/1665; G03G 2215/0129
USPC ..... 399/94, 107, 312, 162, 303
See application file for complete search history.

(56) References Cited

U.S. PATENT DOCUMENTS 6,901,234 B2 5/2005 Ogiyama et al.
6,947,693 B2 9/2005 Kamiya et al.
7,502,583 B2 3/2009 Sawai et al.
7,532,370 B2 5/2009 Kudo et al.
7,742,721 B2 6/2010 Mimbu
7,773,928 B2 8/2010 Ogiyama et al.
8,036,550 B2 10/2011 Minbu
2008/0232867 A1 9/2008 Minbu et al.
2009/0060611 A1 3/2009 Minbu
2009/0279927 A1 11/2009 Fujita
2010/0061741 A1 3/2010 Minbu
2010/0067952 A1 3/2010 Fujita et al.

(Continued)

FOREIGN PATENT DOCUMENTS

JP 2004-138813 5/2004
JP 2007-212540 8/2007
JP 2010-164934 7/2010

*Primary Examiner* — Walter L Lindsay, Jr.
*Assistant Examiner* — Roy Y Yi
(74) *Attorney, Agent, or Firm* — Oblon, Spivak, McClelland, Maier & Neustadt, L.L.P.

(57) ABSTRACT

An image forming apparatus includes a plurality of image bearing members to bear a toner image on a surface thereof, a transfer device including a plurality of transfer members and an endless belt formed into a loop and entrained around the transfer members, to transfer the toner images from the image bearing members onto the surface of the belt so that the toner images are superimposed one atop the other on the belt to form a composite toner image, a plurality of cleaning devices including a cleaning blade to remove residual toner remaining on the image bearing members after transfer of the toner images onto the belt, and a plurality of heaters disposed inside the loop formed by the belt. Each of the heaters is disposed between adjacent image bearing members. The belt is interposed between the plurality of heaters and the plurality of image bearing members.

22 Claims, 10 Drawing Sheets

(56) References Cited

U.S. PATENT DOCUMENTS

| | | | |
|---|---|---|---|
| 2010/0142985 | A1 | 6/2010 | Minbe et al. |
| 2010/0221029 | A1 | 9/2010 | Minbu et al. |
| 2010/0272478 | A1 | 10/2010 | Ichihashi |
| 2011/0064487 | A1 | 3/2011 | Ichihashi et al. |
| 2011/0158690 | A1 | 6/2011 | Mimbu et al. |
| 2011/0206399 | A1 | 8/2011 | Fujita et al. |
| 2011/0286759 | A1 | 11/2011 | Ichihashi et al. |
| 2011/0293312 | A1 | 12/2011 | Mimbu et al. |

$$SF\text{-}1 = \frac{(MXLNG)^2}{AREA} \times \frac{\pi}{4} \times 100$$

$$SF\text{-}2 = \frac{(PERI)^2}{AREA} \times \frac{1}{4\pi} \times 100$$

| ROLLER RESISTANCE (Log Ω) | ELECTRICAL DISCHARGE |
|---|---|
| 7.0 | NO |
| 7.5 | NO |
| 8.0 | NO |
| 8.5 | NO |
| 9.0 | NO |
| 9.5 | YES |
| 10.0 | YES |
| 10.5 | YES |

IMAGE FORMING APPARATUS

CROSS-REFERENCE TO RELATED APPLICATION

This patent application is based on and claims priority pursuant to 35 U.S.C. §119 to Japanese Patent Application No. 2011-045459, filed on Mar. 2, 2011 in the Japanese Patent Office, the entire disclosure of which is hereby incorporated by reference herein.

BACKGROUND OF THE INVENTION

1. Field of the Invention

Exemplary aspects of the present invention generally relate to an image forming apparatus, such as a copier, a facsimile machine, a printer, a plotter, or a multi-functional system including a combination thereof.

2. Description of the Related Art

Related-art image forming apparatuses, such as copiers, facsimile machines, printers, or multifunction printers having at least one of copying, printing, scanning, and facsimile capabilities, typically form an image on a recording medium according to image data. Thus, for example, a charger uniformly charges a surface of an image bearing member such as a photoconductor; an optical writer projects a light beam onto the charged surface of the image bearing member to form an electrostatic latent image on the image bearing member according to the image data; a developing device supplies toner to the electrostatic latent image formed on the image bearing member to render the electrostatic latent image visible as a toner image; the toner image is directly transferred from the image bearing member onto a recording medium or is indirectly transferred from the image bearing member onto a recording medium via an intermediate transfer member; a cleaning device then cleans the surface of the image carrier after the toner image is transferred from the image carrier onto the recording medium; finally, a fixing device applies heat and pressure to the recording medium bearing the unfixed toner image to fix the unfixed toner image on the recording medium, thus forming the image on the recording medium.

In such image forming apparatuses, after the toner image is transferred onto the recording medium, toner residue remaining on the surface of the image bearing member is removed by a cleaner such as a cleaning blade in preparation for the subsequent imaging cycle.

In a color-image forming apparatus, such as a tandem-type image forming apparatus, a plurality of photoconductors, one for each of the colors black, yellow, magenta, and cyan, are arranged in tandem facing a belt-type intermediate transfer member (hereinafter simply referred to as an intermediate transfer belt), and multiple toner images of a respective single color are formed on the photoconductive drums. Then, the toner images are transferred onto the intermediate transfer belt so that they are superimposed one atop the other, thereby forming a composite toner image. This process is known as a "primary transfer process". After the primary transfer process, the composite toner image may be transferred onto a recording medium, in a process known as a "secondary transfer process". Alternatively, the toner images may be directly transferred onto a recording medium carried on a sheet conveyance belt.

Some common problems with such an electrophotographic image forming apparatus are known. For example, poor cleaning of the photoconductive drums causes streaks in an output image, and electrical discharge in the transfer device causes voids.

When the cleaner employs a blade-type cleaning member, the blade tends to stiffen in a low-temperature, low-humidity environment. A cleaning blade that has stiffened cannot conform to the surface of the photoconductor, preventing the cleaning blade from contacting the photoconductor evenly.

To address this difficulty, a heater such as a wire heater may be disposed near the photoconductor. However, as is generally the case, because various imaging devices are disposed around the photoconductor there is no extra space near the photoconductor for disposing the heater near the photoconductor. Consequently, the heater is typically located some distance from the photoconductor. In this case, however, the temperature near the photoconductive drums varies from locally, causing variation in the performance of the cleaner but also affecting the electrical resistance of the transfer member. That is, electrical resistance in general varies with temperature and humidity, and is high in a low-temperature, low-humidity environment and low in a high-temperature, high-humidity environment. As the electrical resistance of the transfer member increases, electrical discharge occurs in the transfer device, causing voids in the output image.

Thus, for example, in wintertime, if the image forming apparatus is turned on in the morning, the electrical resistance of the transfer member is too high, generating an electrical discharge. As a result, during the transfer process, the electrical discharge causes a void in the toner image. To a certain extent this problem is self correcting: As the image forming apparatus remains in operation continuously, the internal temperature of the image forming apparatus rises, thereby decreasing the electrical resistance of the transfer member. Accordingly, an image with voids is not produced. But the problem of consistency remains unresolved.

In view of the above, there is demand for an image forming apparatus that is capable of reliably producing good images regardless of temperature variance.

BRIEF SUMMARY

In view of the foregoing, in an aspect of this disclosure, an image forming apparatus includes a plurality of image bearing members, a transfer device, a plurality of cleaning devices each of which including a cleaning blade, and a plurality of heaters. The plurality of image bearing members bears an electrostatic latent image on a surface thereof. The transfer device includes a plurality of transfer members and an endless belt formed into a loop and entrained around the transfer members, to transfer the toner images from the plurality of image bearing members onto the surface of the belt so that the toner images are superimposed one atop the other on the belt to form a composite toner image. The plurality of cleaning devices includes a cleaning blade to clean the surface of the plurality of image bearing members after transfer of the toner images from the image bearing members onto the surface of the belt. The plurality of heaters is disposed inside the loop formed by the belt, and each heater is disposed between adjacent image bearing members. The belt is interposed between the plurality of heaters and the plurality of image bearing members.

The aforementioned and other aspects, features and advantages would be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF DISCLOSED EMBODIMENTS

Figure 1:
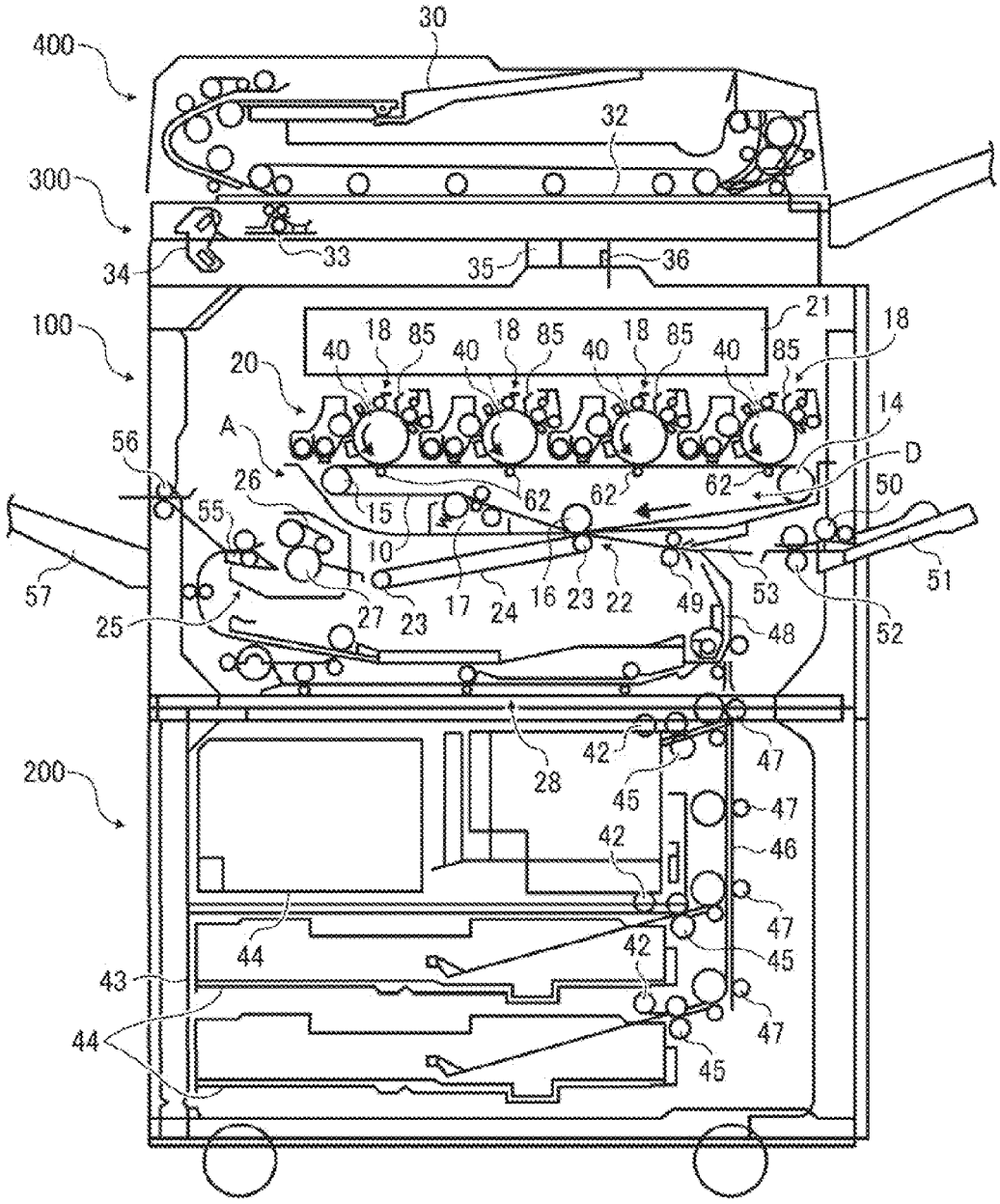
FIG. 1 is a schematic diagram illustrating an image forming apparatus according to an aspect of the disclosure.

A description is now given of illustrative embodiments of the present application. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially with reference to FIG. 1, a description is provided of a copier as an example of an image forming apparatus according to an aspect of the disclosure.

FIG. 1 is a schematic diagram illustrating a copier as an example of an image forming apparatus according to the illustrative embodiment of the present invention. The image forming apparatus includes a copier main body 100, a sheet feed unit 200 disposed below the main body 100, a scanner 300 disposed above the main body 100, an automatic document feeder 400 (hereinafter referred to as an ADF) disposed above the scanner 300.

The main body 100 includes an intermediate transfer belt 10 disposed substantially in the center of the main body 100. The intermediate transfer belt 10 forms an endless belt loop wound around a first support roller 14, a second support roller 15, and a third support roller 16, and is rotated in a clockwise direction.

A belt cleaning device 17 is disposed between the second support roller 15 and the third support roller 16 to clean residual toner remaining on the intermediate transfer belt 10 after a toner image on the intermediate transfer belt 10 is transferred onto a recording medium.

Above the intermediate transfer belt 10 stretched taut between the first support roller 14 and the second support roller 15, four image forming stations 18, one for each of the colors black, cyan, magenta, and yellow, are arranged horizontally in tandem along a direction of movement of the intermediate transfer belt 10, thereby constituting a tandem-type image forming unit 20. It is to be noted that the order of the image forming stations 18 is not limited thereto.

An exposure device 21 is disposed above the image forming unit 20. A secondary transfer unit 22 is disposed on the other side of the image forming unit 20 via the intermediate transfer belt 10. The secondary transfer unit 22 includes two rollers 23 and a secondary transfer belt 24. The secondary transfer belt 24 is wound around the rollers 23 and forms an endless loop. The secondary transfer belt 24 is pressed against the third support roller 16 with the intermediate transfer belt 10 interposed therebetween to transfer a toner image borne on the intermediate transfer belt 10 onto a recording medium, such as a sheet of paper.

At the left side of the secondary transfer unit 22, a fixing device 25 for fixing a toner image on the recording medium is disposed. The fixing device 25 includes a fixing belt 26 and a pressing roller 27. The fixing belt 26 forms an endless loop and is pressed against the pressing roller 27.

The secondary transfer device 22 is equipped with a sheet conveyance function which transports the recording medium to the fixing device 25 after the toner image is transferred thereon. Alternatively, as a secondary transfer unit, a non-contact type charger may be provided.

A sheet reversing unit 28 is disposed substantially below the secondary transfer unit 22 and the fixing device 25, substantially parallel to the image forming unit 20. The sheet reversing unit 28 turns over the sheet to form an image on both sides of the sheet.

Still referring to FIG. 1, a description is provided of image forming operation for a color image. First, an original document is placed on a document table 30 of the ADF 400 or on a contact glass 32 of the scanner 300 by opening the ADF 400. When the document is placed on the contact glass 32, the ADF 400 is closed. When pressing a start button, not illustrated, of the image forming apparatus, the document in the ADF 400 is conveyed onto the contact glass 32. When directly placing the document on the contact glass 32, the scanner 300 is driven immediately, enabling a first carriage 1 and a second carriage 33 to scan the document.

A light source of the first carriage 33 projects light against the document, which is then reflected on the document. The reflected light is reflected towards the second carriage 34. A mirror of the second carriage 34 reflects the light towards a focusing lens 35 which directs the light to a read sensor 36. The read sensor 36 reads the document.

When the start button is pressed, the drive motor, not illustrated, is driven, enabling one of the support rollers 14, 15, and 16 to rotate, and other two rollers to follow, enabling the intermediate transfer belt 10 to move. (In the present embodiment, the support roller 14 is driven, for example.) Simultaneously, photoconductive drums 40 serving as image bearing members, one for each of the colors black (K), yellow (Y), magenta (M), and cyan (C), in the image forming stations 18 start to rotate so that toner images of the respective colors are formed thereon.

As the intermediate transfer belt 10 moves, the toner images on the photoconductive drums 40 are transferred primarily onto the intermediate transfer belt 10 by primary transfer rollers 62 so that they are superimposed one atop the other, thereby forming a composite toner image on the intermediate transfer belt 10. The primary transfer rollers 62 are disposed inside the loop formed by the intermediate transfer belt 10, each facing the photoconductive drums 40.

Each of the image forming stations 18 is equipped with a cleaning blade 85 serving as a cleaning device for cleaning the surface of the photoconductive drum 40. The cleaning blade 85 contacts the surface of the photoconductive drum 40 and removes residual toner remaining on the surface thereof after the toner image is transferred onto the intermediate transfer belt 10.

As for sheet feeding operation, when the start button is pressed, one of sheet feed rollers 42 of the sheet feeding unit 200 is selected to rotate, thereby feeding a recording medium from a stack of recording media sheets in a respective sheet cassette 44 of a paper bank 43. The paper bank 43 is equipped with multiple sheet cassettes 44, each storing a stack of recording media sheets. The recording medium is fed to a sheet conveyance path 46, one sheet at a time by a separation roller 45. A pair of conveyance rollers 47 transports the recording medium to a pair of registration rollers 49 along a printer sheet path 48 in the copier main body 100. The recording medium stops at the registration rollers 49.

In a case in which the recording medium is fed manually, a pickup roller 50 is rotated to pick up the recording medium placed on a manual feed tray 51 and send it to a separation roller 52. The separation roller 52 then sends the recording medium to a manual feed path 53 in the copier main body 100, one sheet at a time. The recording medium is stopped temporarily by the pair of registration rollers 49.

Subsequently, rotation of the pair of registration rollers 49 resumes, and the recording medium is sent to a secondary transfer nip between the intermediate transfer belt 10 and the secondary transfer belt 24 of the secondary transfer unit 22 in appropriate timing such that the recording medium is aligned with the composite color toner image formed on the intermediate transfer belt 10. Then, the composite color toner image on the intermediate transfer belt 10 is transferred onto the recording medium in the secondary transfer nip in the secondary transfer unit 22.

After the composite toner image is transferred onto the recording medium in the secondary transfer unit 22, the recording medium is transported to the fixing device 25 by the secondary transfer unit 22. In the fixing device 25, heat and pressure are applied to the recording medium, thereby fixing the composite toner image on the recording medium. Subsequently, the direction of transport of the recording medium is switched by a switching claw 55 to a pair of discharge rollers 56 so that the recording medium is discharged onto a sheet output tray 57. Alternatively, the switching claw 55 may guide the recording medium to the sheet reversing unit 28 in which the recording medium is turned over so that an image is formed on the other side of the recording medium. After the image is formed on the other side, the recording medium is discharged by the pair of discharge rollers 56 onto the sheet output tray 57.

After the toner image is transferred from the intermediate transfer belt 10, the surface of the intermediate transfer belt 10 is cleaned by the belt cleaning device 17 to remove residual toner remaining on the intermediate transfer belt 10 in preparation for the subsequent imaging cycle.

According to the illustrative embodiment, the intermediate transfer belt 10 is comprised of a single layer or multiple layers including, but not limited to, polyimide (PI), polyvinylidene fluoride (PVDF), ethylene tetrafluoroethylene (ETFE), and polycarbonate (PC). Additionally, in order to adjust the resistance, a conductive material such as carbon black is dispersed in a layer of the intermediate transfer belt 10 so that the volume resistivity thereof is adjusted to within a range from $10^8$ Ωcm to $10^{12}$ Ωcm, and a surface resistivity thereof is adjusted to within a range from to $10^9$ Ωcm to $10^{13}$ Ωcm. The surface of the intermediate transfer belt 10 may be covered with a release layer, as necessary. Material for the release layer may include, but is not limited to, fluorocarbon resin such as ETFE, polytetrafluoroethylene (PTFE), PVDF, perfluoroalkoxy polymer resin (PFA), fluorinated ethylene propylene (FEP), and polyvinyl fluoride (PVF).

The intermediate transfer belt 10 is manufactured through a casting process, a centrifugal casting process, and the like. The surface of the intermediate transfer belt 10 may be polished as necessary.

If the volume resistivity of the intermediate transfer belt 10 exceeds the above described range, the bias necessary for the transfer process increases, hence increasing the power and its cost. Furthermore, an electrical potential of the intermediate transfer belt 10 increases during the transfer process and separation of the recording medium from the intermediate transfer belt 10, hindering self discharge. As a result, a charge eliminating device is required.

By contrast, if the volume resistivity and the surface resistivity are below the above described range, attenuation of the electrical potential is fast, which is advantageous for elimination of charge. However, an electrical current flows in both directions during transfer, causing toner to scatter.

For the reasons described above, the volume resistivity and the surface resistivity of the intermediate transfer belt 10 need to be within the above described range. The volume resistivity and the surface resistivity can be measured by connecting an HRS Probe having an inner electrode diameter of 5.9 mm and an (inner) ring caliber of 11 mm (manufactured by Mitsubishi Chemical, Ltd.) to a high resistivity meter, Hiresta IP, (manufactured by Mitsubishi Chemical, Ltd.). The volume resistivity is calculated after 10 seconds elapses when a voltage of 100 V (for the surface resistivity, a voltage of 500 V) is applied to both sides of the intermediate transfer belt 10.

It is to be noted that the toner used in the illustrative embodiment is polymerized toner formed through a polymerization method.

Figure 2:
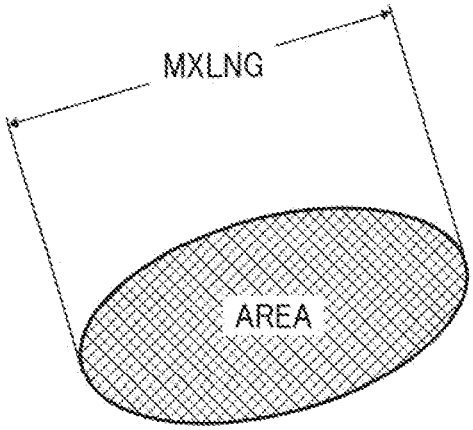
FIG. 2 is a schematic diagram illustrating a toner particle for explaining a shape factor SF-1.
Figure 3:
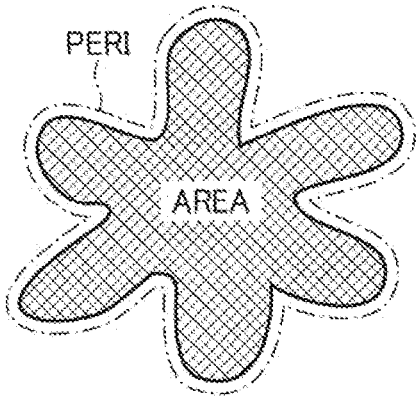
FIG. 3 is a schematic diagram illustrating a toner particle for explaining a shape factor SF-2.

The toner preferably has a shape factor SF-1 in a range of from 100 to 180 and another shape factor SF-2 in a range of from 100 to 180. With reference to FIGS. 2 and 3, a description is provided of a shape of a toner particle for explaining the shape factors SF-1 and SF-2. FIG. 2 is a schematic diagram illustrating a toner particle for explaining the shape factor SF-1. FIG. 3 is a schematic diagram illustrating a toner particle for explaining the shape factor SF-2.

The shape factor SF-1 represents the degree of roundness of a toner particle and is represented by the following formula (1): SF-1={(MXLNG) 2/AREA}×(100 Π/4), wherein MXLNG represents the maximum diameter of a projected image of a toner particle on a two-dimensional plane and AREA represents the area of the projected image. The shape factor SF-1 is calculated by dividing a square of the maximum diameter (MXLNG) of the projected image of the toner particle on the two-dimensional plane by the area (AREA) of the image, and multiplying the result by 100 Π/4.

When SF-1 is 100, the toner particle has a true spherical shape. The greater the SF-1, the more irregular the toner shape.

The shape factor SF-2 represents the degree of roughness of a toner particle, and is represented by the following formula (2): SF-2={(PERI) 2/AREA}×(100 Π/4), wherein PERI represents a perimeter of a projected image of a toner particle on a two-dimensional plane and AREA represents the area of the projected image. The shape factor SF-2 is calculated by dividing a square of the perimeter (PERI) of the projected image of the toner particle on the two-dimensional plane by the area (AREA) of the image, and multiplying the result by 100 Π/4.

When SF-2 is 100, the toner particle has a completely smooth surface without roughness. The greater the SF-2, the rougher the toner surface.

To obtain the shape factors SF-1 and SF-2, a target toner is photographed using a scanning electron microscope (S-800 manufactured by Hitachi, Ltd.), and analyzed using an image analyzer (LUSEX 3 manufactured by NIRECO Corporation).

When a toner particle has a shape close to a sphere, contact between toner particles or that between a toner particle and a photoconductor is made at a point, which weakens adhesion between toner particles, thereby increasing the fluidity of the toner. Because adhesion between the toner and the photoconductor is also weakened, transfer efficiency is increased. When any one of the shape factors SF-1 and SF-2 exceeds 180, the transfer efficiency may deteriorate. Furthermore, such toner is difficult to clean once adhered to a transfer member.

A volume average particle diameter of toner is preferably in the range of from 4 to 10 micrometers. When printing is performed using a toner having the volume average particle diameter smaller than 4 micrometers, smear can occur in a not-to-be-printed area, or a void can be developed because the toner has poor fluidity and is likely to be agglomerated during development. On the other hand, printing using a toner having the volume average particle size greater than 10 micrometer can result in toner scattering and/or degradation in resolution. Therefore, the toner having the volume average particle diameter approximately 6.5 micrometers is most preferable.

Figure 4:
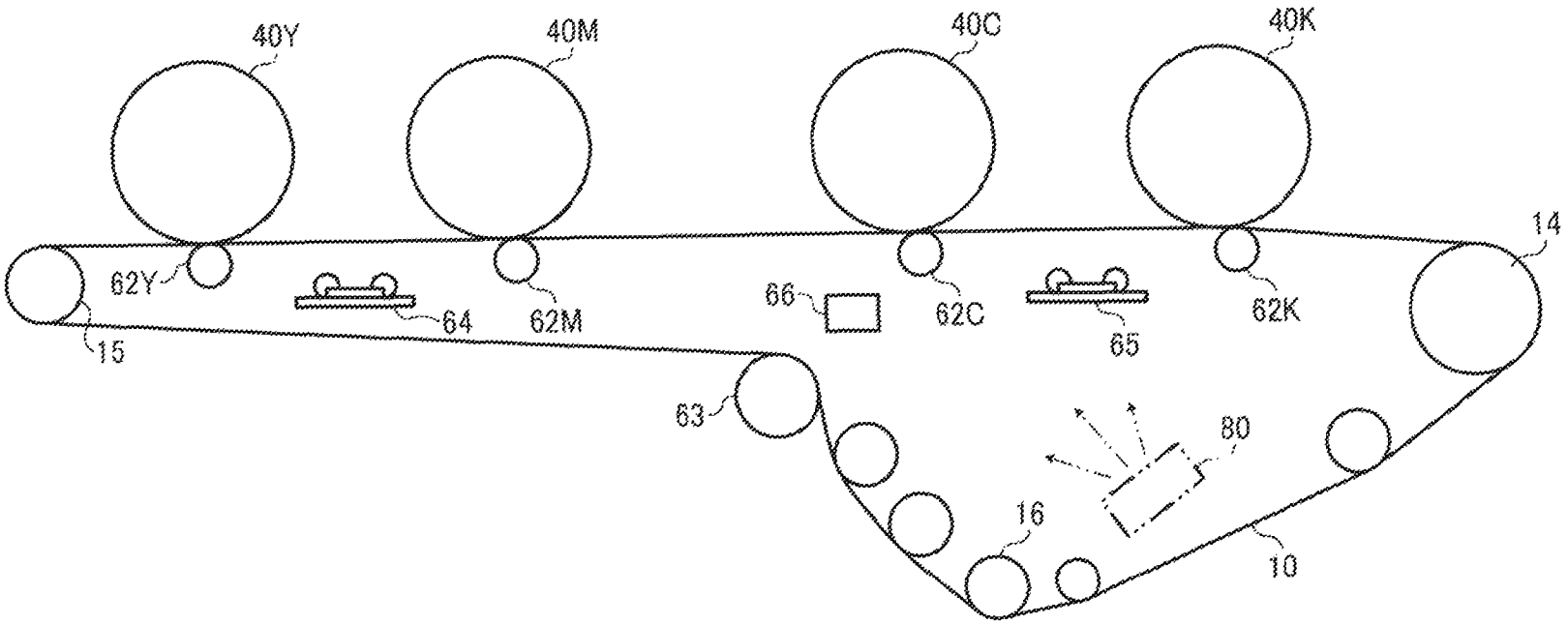
FIG. 4 is a schematic diagram illustrating relative positions of photoconductive drums and heaters in the image forming apparatus.

Next, with reference to FIG. 4, a description is provided of arrangement of a heater according to an illustrative embodiment. FIG. 4 is a schematic diagram illustrating the photoconductive drums 40Y, 40M, 40C, and 40K (collectively referred to as 40) and an intermediate transfer mechanism including the intermediate transfer belt 10 and the primary transfer rollers 62Y, 62M, 62C, and 62K (collectively referred to as 62). It is to be noted that the suffixes Y, M, C, and K denote colors yellow, magenta, cyan, and black, respectively.

As illustrated in FIG. 4, a heater 64 is disposed inside the loop formed by the intermediate transfer belt 10, between the photoconductive drum 40Y and the adjacent photoconductive drum, that is, the photoconductive drum 40M. A heater 65 is also disposed inside the loop formed by the intermediate transfer belt 10, between the photoconductive drum 40C and an adjacent photoconductive drum, that is, the photoconductive drum 40K. In this configuration, the intermediate transfer belt 10 moves between the heaters 64 and 65, and the photoconductive drums 40.

In FIG. 4, a tension roller 63 is disposed outside loop formed by the intermediate transfer belt 10. A bimetal thermostat 66 that turns on and off the heaters 64 and 65 is disposed inside the loop thereof.

Figure 5:
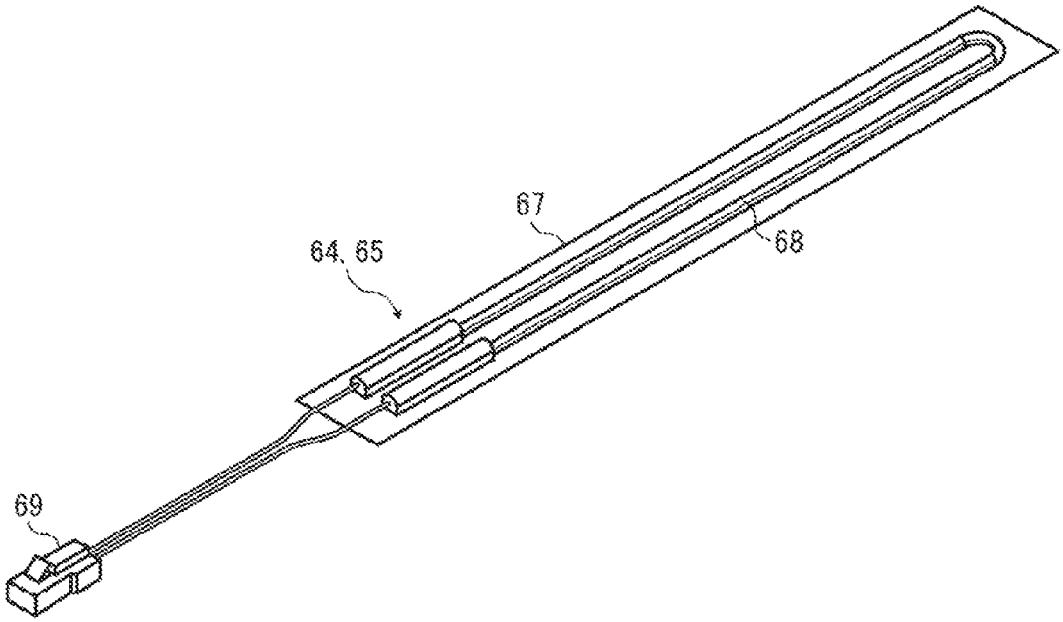
FIG. 5 is a perspective view schematically illustrating the heater of FIG. 4.

Referring now to FIG. 5, a description is provided of the heaters 64 and 65. FIG. 5 is a perspective view schematically illustrating the heaters 64 and 65. According to the illustrative embodiment, the heaters 64 and 65 are Nichrome wire heaters with a rated voltage of 200 V and a wattage of 9 W. However, the heaters 64 and 65 are not limited to this. Any other suitable heaters may be employed.

Rise of the surface temperature is 80° C.±20° C. An aluminum foil 67 with a thickness of approximately 0.05 mm is used. A heating element 68 employs an insulating heating element made of silicon rubber. A switch 69 is connected to the heater. As will be described later, the heaters 64 and 65 are fixed to a heater retainer 70 (71) made of, for example, a metal planar member and molded resin using double-sided tape. The heater retainer 70 (71) is then attached to the place in the image forming apparatus where appropriate.

The heaters 64 and 65 are turned on and off by the thermostat 66. According to the illustrative embodiment, the thermostat 66 is a low temperature thermostat. However, the thermostat is not limited to this. Depending on the temperature, the shape of the bimetal thermostat 66 deforms, thereby turning on and off the switch 69 of the heaters 64 and 65.

According to the illustrative embodiment, the heaters 64 and 65 are turned on when the temperature is equal to or less than 22° C., and turned off when the temperature is equal to or higher than 32° C. However, the temperature is not limited to this.

Depending on the capacity of the heater, if the heater is disposed in a developing device and a cleaning device, both of which are disposed relatively near the photoconductive drums 40, toner may melt and adhere to the devices. To address this difficulty, as illustrated in FIG. 4, the heaters 64 and 65 are disposed in the intermediate transfer mechanism (inside the loop formed by the intermediate transfer belt 10).

Figure 6:
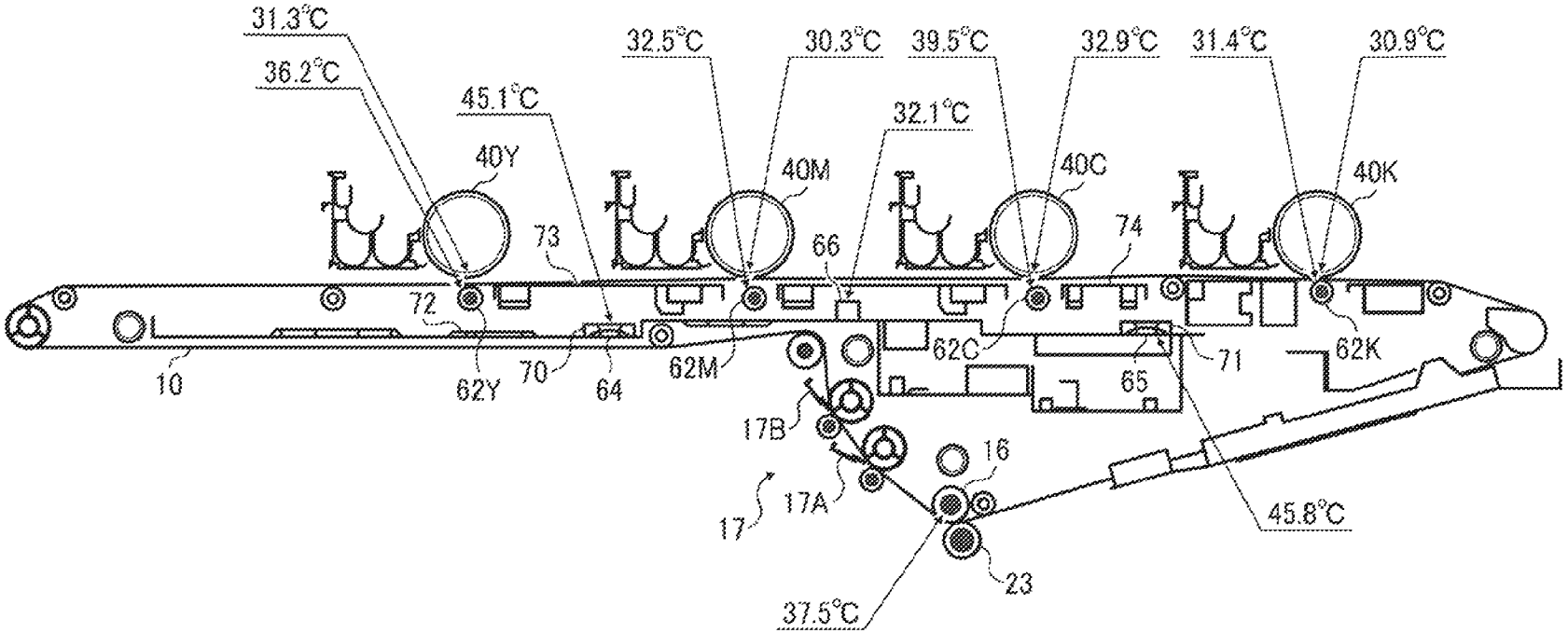
FIG. 6 is a schematic diagram illustrating saturated temperatures of various devices in an image forming unit of the image forming apparatus.

With reference to FIG. 6, a description is provided of saturated temperatures of various devices in the image forming apparatus when the heater capacity is 9 W and the environmental temperature is 26.5° C. FIG. 6 is a schematic diagram illustrating various devices in the intermediate transfer mechanism and the photoconductive drums 40, and the saturated temperatures thereof.

As illustrated in FIG. 6, the temperatures of the primary transfer rollers 62B through 62Y (from the right to the left in FIG. 6) inside the looped intermediate transfer belt 10 are: 31.4° C., 39.5° C., 32.5° C., and 36.2° C. The difference between the highest temperature and the lowest temperature is 8.1° C. By contrast, the temperatures of the photoconductive drums 40K through 40Y (from the right to the left) outside the looped intermediate transfer belt 10 are: 30.9° C., 32.9° C., 30.3° C., and 31.3° C. The difference between the highest temperature and the lowest temperature is 2° C.

As is understood from FIG. 6, the temperature of the primary transfer rollers 62 depends on the distance from the heaters 64 and 65. More specifically, the closer the primary transfer roller 62 is to the heater 64 and 65, the higher the temperature of the primary transfer roller 62.

However, although the distance between the photoconductive drums 40 and the heaters 64 and 65 is similar to the distance between the primary transfer rollers 62 and the heaters 64 and 65, the difference between the temperatures of the photoconductive drums 40 is not as much as the difference between the temperatures of the primary transfer rollers 62. Since the intermediate transfer belt 10 is interposed between the heaters 64 and 65, and the photoconductive drums 40, sensitivity of the photoconductive drums 40 relative to the distance from the heaters is reduced. In other words, the temperature variance due to the distance is evened out by moving the intermediate transfer belt 10.

As illustrated in FIG. 6, the heater 64 or the left heater is disposed on the heater retainer 70 serving as a heater mount. The right heater 65 is disposed on the heater retainer 71 serving as a heater mount. The heater retainers 70 and 71 are constituted as metal planar members. A belt guide member 72 made of a metal sheet frame is disposed inside the loop formed by the intermediate transfer belt 10. An upper cover 73 is disposed above the heater 64 (left) to cover the heater 64. An upper cover 74 is disposed above the heater 65 (right) to cover the heater 65. Cleaning blades 17A and 17B are disposed outside the loop formed by the intermediate transfer belt 10 to clean the surface of the intermediate transfer belt 10.

The upper covers 73 and 74 extend from a position above the respective heaters 64 and 65 to the adjacent photoconductive drums 40. The distance between each end of the cover and the adjacent image bearing member 40 is similar to the distance between the other end of the cover and the adjacent image bearing member 40.

Figures 7, 8:
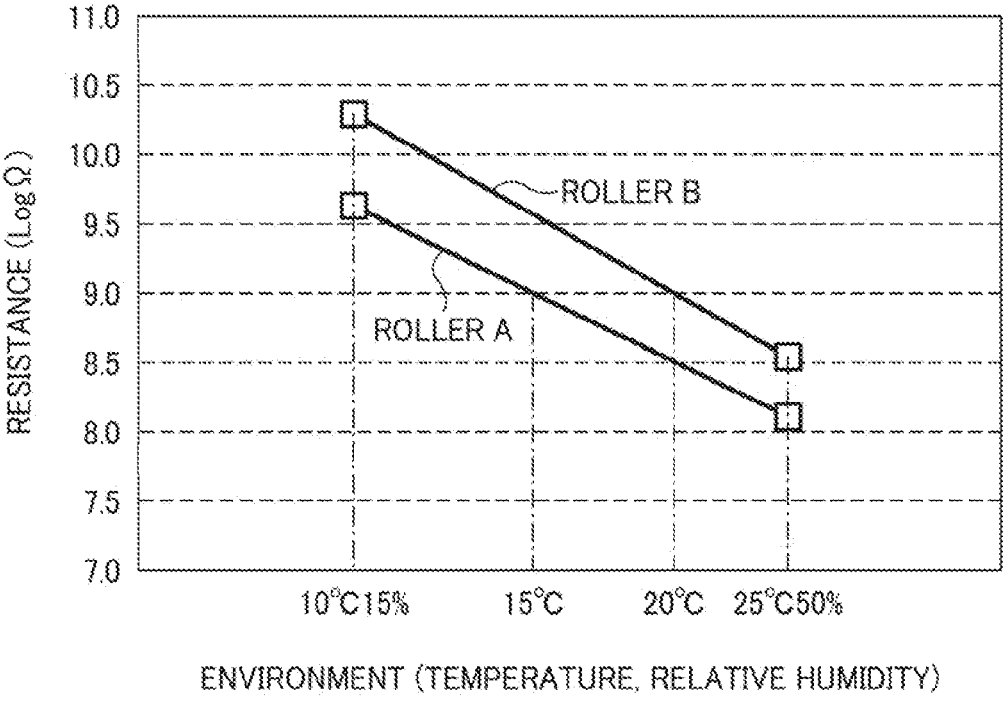
FIG. 7 is a graph showing a resistance variance of a primary transfer roller due to environmental changes (temperature and relative humidity)
FIG. 8 is a table showing test results of the resistance of a transfer roller and electrical discharge.

With reference to FIG. 7, a description is provided of the primary transfer roller 62. FIG. 7 is a graph showing a resistance variance of the primary transfer roller 62 due to environmental changes (temperature and relative humidity) as an example of a cause of the resistance variance. The primary transfer roller 62 in the present embodiment includes a shaft made of metal such as iron, SUS, and AI, and an ionic conductive foam resin layer with a thickness in a range of from 2 mm to 10 mm provided on the metal shaft.

As is understood from FIG. 7, a resistance value is 8.1 Log Ω when the temperature is 25° C. and the relative humidity is 50% using a roller A. By contrast, the resistance value increases to 9.6 Log Ω when the temperature is 10° C. and the relative humidity is 15%. As shown in FIG. 8, the electrical discharge in the transfer unit occurs when the resistance value is equal to or greater than 9.5 Log Ω. FIG. 8 is a table showing test results of the resistance of the transfer roller and electrical discharge. In FIG. 8, "NO" indicates no electrical discharge, and "YES" indicates occurrence of an electrical discharge.

The resistance value is measured such that a metal roller is pressed against the primary transfer roller 62 at a load of 5N and supplied with a voltage DC1 kV. A resistance is obtained by Ohm's law V=IR, where V is a voltage, I is a current, and R is a resistance.

Figure 9:
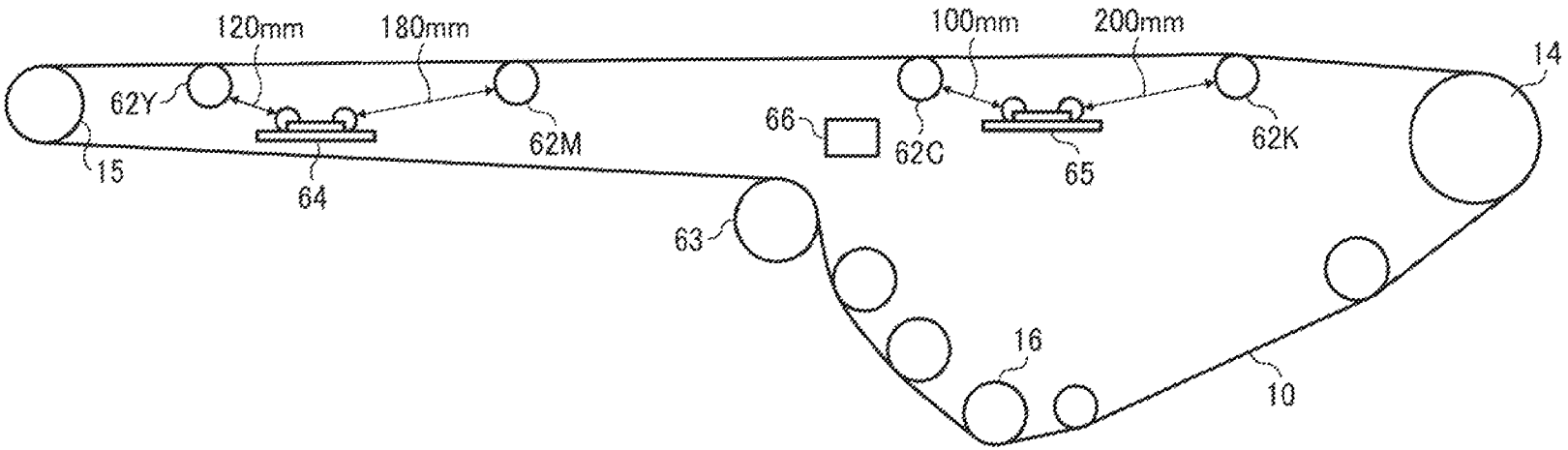
FIG. 9 is a schematic diagram illustrating an example distance between the primary transfer rollers and the heaters for an experiment.
Figure 10:
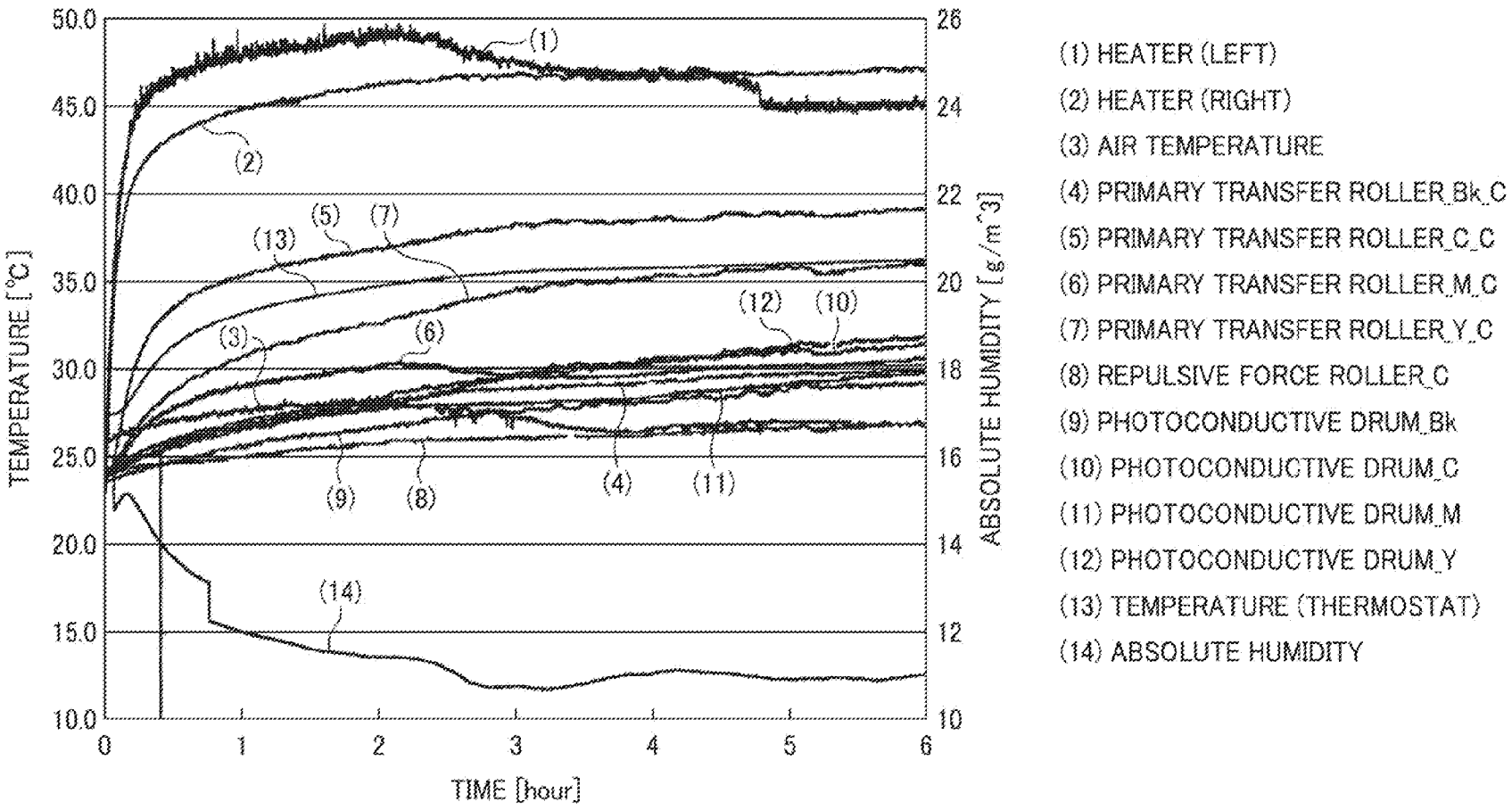
FIG. 10 is a graph showing changes in the temperature of the heaters, the primary transfer rollers, and the photoconductive drums when the heater is turned on at the environment temperature of 25° C.

With reference to FIGS. 9 and 10, a description is provided of generation of voids (a trace of electrical discharge) and the distance between the heater and the primary transfer roller 62 that causes the voids. FIG. 9 a schematic diagram illustrating an example distance between the primary transfer rollers 62 and the heaters 64 and 65 for an experiment. FIG. 10 is a graph showing changes in the temperature of the heaters 64 and 65, the primary transfer rollers 62, and the photoconductive drums 40 when the heater is turned on at the environment temperature of 25° C.

As illustrated in FIG. 9, the distance between the primary transfer roller 62Y and the heater 64 is 120 mm. The distance between the primary transfer roller 62M and the heater 64 is 180 mm. The distance between the primary transfer roller 62C and the heater 65 is 100 mm. The distance between the primary transfer roller 62B and the heater 65 is 200 mm. The thermostat 66 is disposed substantially at the center of the loop formed by the intermediate transfer belt 10.

It is to be noted that the distance between the heaters 64 and 65 and the primary transfer rollers 62 shown in FIG. 9 is merely an example to show the relation of the electrical discharge and the distance between the heaters and the primary transfer rollers. Hence, the actual distance between the primary transfer rollers and the heaters is not limited to this.

As is understood from FIG. 10, the shorter the distance between the primary transfer roller 62 and the heater 64 (65), the higher the temperature of the primary transfer roller 62.

Referring back to FIGS. 7 and 8, the resistance of the primary transfer roller that does not cause voids is 9.0 Log Ω. The temperature at which the resistance is 9.0 Log Ω is 15° C. for the roller A and 20° C. for the roller B. In order to prevent the void for both the rollers A and B, the temperature needs to increase by approximately +10° C. from the environment temperature of 10° C.

In FIG. 10, the roller, the temperature of which rises by 10° C. from the ambient temperature of 25° C., is the primary transfer roller 62Y. Therefore, in order to prevent the void, a positional relation similar to that of the positional relation between the primary transfer roller 62Y and the heater 64 is needed. More particularly, the distance between the primary transfer roller 62 and the heater needs to be equal to or less than 120 mm to prevent the void. Arrangement of the primary transfer rollers 62 and the heaters 64 and 65 shown in FIG. 4 is made based on the experiment described above.

Figure 11:
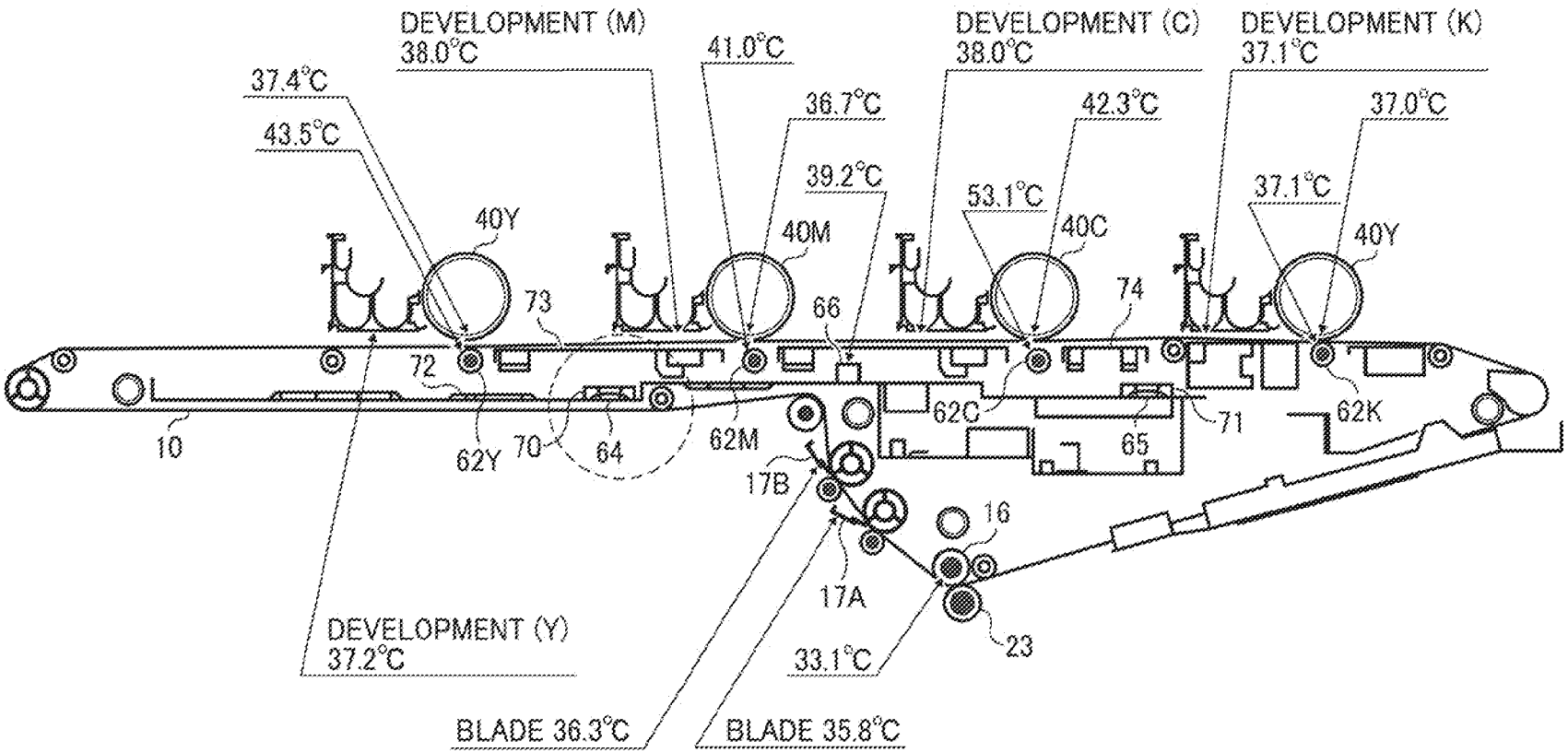
FIG. 11 is a schematic diagram illustrating temperatures of the devices when the heater is turned on when the ambient temperature is 32° C.

FIG. 11 shows the temperatures of various devices when the heaters are turned on under the ambient temperature of 32° C. The temperatures of the primary transfer rollers 62K through 62Y from the right to the left inside the loop formed by the intermediate transfer belt 10 are 37.1° C., 53.1° C., 41.0° C., 43.0° C., respectively. The difference between the lowest temperature and the highest temperature (MAX–MIN) is approximately 16° C.

By contrast, the temperatures of the photoconductive drums 40 are 37.0° C., 42.3° C., 36.7° C., and 37.4° C. from the right to the left, and the difference between the lowest temperature and the highest temperature is 5.6° C. In this case, because the intermediate transfer belt 10 is interposed between the photoconductive drums 40 and the heaters 64 and 65, sensitivity of the photoconductive drums 40 relative to the distance from the heaters is reduced.

Figure 12A:
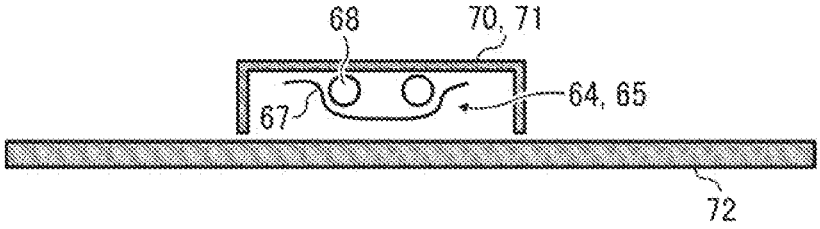
FIG. 12A is a front view schematically illustrating a belt guide member for an intermediate transfer belt and a heater mount.
Figure 12B:
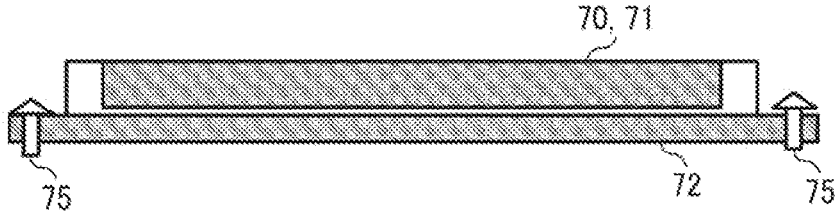
FIG. 12B is a side view schematically illustrating the belt guide member and the heater mount.

With reference to FIGS. 12A and 12B, a description is provided of installation of the heater 64 (65). FIG. 12A is a front view schematically illustrating the heater 64 (65), the belt guide member 72, and the heater retainer 70 (71). FIG. 12B is a side view schematically illustrating the belt guide member 72, the heater retainer 70 (71), and fasteners 75. It is to be noted that the heater 65 is installed in the same manner as the heater 64.

As illustrated in FIG. 12A, the heater 64 is adhered to the rear surface of the heater retainer 70 via the aluminum foil 67 using double-sided tape. The heater retainer 70 includes the fasteners 75. In the present embodiment, the fasteners 75 that fix the heater retainer 70 to the belt guide member 72 are screws. Except at the fasteners 75, the heater retainer 70 does not contact the belt guide member 72.

Figure 13:
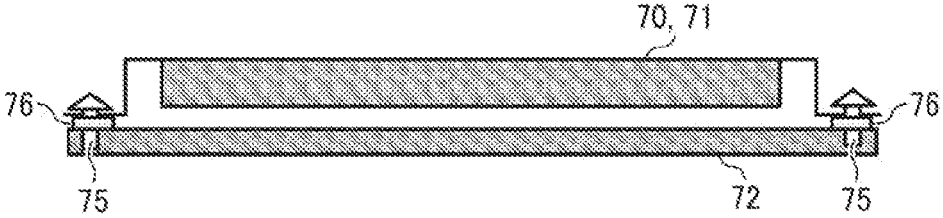
FIG. 13 is a front view schematically illustrating the belt guide member and the heater according to another illustrative embodiment of the present invention.

Heat transmission from the heater retainer 70 to the belt guide member 72 is suppressed because the area of the fastener 75 is relatively small. This means that heat from the heater 64 is transmitted mostly through air. Alternatively, if a heat insulator 76 is disposed at the fastener 75 as illustrated in FIG. 13, transmission of heat to the belt guide member 72 is suppressed more reliably. That is, the heat insulator 76 may be disposed between the heater retainer 70 and the belt guide member 72 at the fastener 75.

According to the illustrative embodiments, the heater is turned on when the power of the image forming apparatus is off or in standby mode. This means there is not much air flow inside the image forming apparatus. This is why the temperature depends on the distance from the heater. More specifically, when the distance from the heater varies, the temperature varies locally as well.

In a case in which the desired distance between the primary transfer rollers 62, and the heaters 64 and 65 is difficult to obtain, a fan 80 indicated by a broken line in FIG. 4 may be disposed inside the loop formed by the intermediate transfer belt 10 to circulate air forcibly to reduce temperature variance.

Next, a description is provided of an example of the intermediate transfer belt 10. According to the illustrative embodiments, the intermediate transfer belt 10 is an elastic belt. The intermediate transfer belt 10 of the present invention has a multi-layered structure including a surface layer, a core layer, and an elastic layer.

Conventionally, the intermediate transfer belt is made of resin such as fluorine-based resin, polycarbonate resin, and polyimide resin. However, in recent years, use of an elastic member in an entire belt (all layers) or a portion of the belt has become more frequent. The belt using the resin has following difficulty in transfer of a color image.

Generally, a color image is formed using four base colors. More specifically, a color image contains four layers of toner, that is, toner images, one for each of the colors yellow, magenta, cyan, and black, are superimposed one atop the other, thereby forming a composite color toner image. The toner layers are pressed in the primary transfer in which toner images are transferred from the photoconductive drums onto the intermediate transfer belt, and also in the secondary transfer in which the composite toner image is transferred from the intermediate transfer belt to the recording medium. As the toner layers are pressed, adhesion of toner particles increases. High adhesion of toner may cause a disturbance of the toner image, such as a hollow defect. Because the belt made of resin has a high stiffness, the belt does not deform to conform to the shape of the toner layer, hence compressing undesirably the toner layer. As a result, the disturbance of toner image occurs.

Furthermore, market demand has also grown for producing a color image on various types of recording media sheets such as rice paper and paper having a rough surface. For the recording medium with a rough surface, a gap is easily formed between the surface of the recording medium and the toner, causing poor transfer of the toner image. To counteract such a difficulty, the transfer pressure in the secondary transfer nip may be increased so that the recording medium contacts tightly the toner. However, strong stress is applied to the toner layer, thereby increasing adhesion of the toner particles in the toner layer. As a result, the disturbance of toner image still occurs.

By contrast, an elastic belt can deform easily to conform to the shape of the toner layer and the surface of the recording medium with a rough surface. In other words, the intermediate transfer belt 10 using the elastic belt can intimately contact toner layers without applying excessive transfer pressure and can uniformly transfer the toner layer even onto a recording medium with a rough surface.

Resins for the elastic belt include, but are not limited to, polycarbonate, fluorine-based resins (e.g., ETFE, PVDF), styrene-based resins (i.e., homopolymers and copolymers of styrene or styrene derivatives) such as polystyrene, chloropolystyrene, poly-a-methylstyrene, styrene-butadiene copolymer, styrene-vinyl chloride copolymer, styrene-vinyl acetate copolymer, styrene-maleic acid copolymer, styrene-acrylate copolymers (e.g., styrene-ester acrylate copolymer, styrene-methyl acrylate copolymer, styrene-ethyl acrylate copolymer, styrene-butyl acrylate copolymer, styrene-octyl acrylate copolymer, styrene-phenyl acrylate copolymer), styrene-α-chloracryate methyl copolymer, styrene-acrylonitrile acrylate ester copolymer and styrene-ester methacrylate copolymers (e.g., styrene-methyl methacrylate copolymer, styrene-ethyl methacrylate copolymer, styrene-phenyl methacrylate copolymer), methyl methacrylate resin, butyl methacrylate resin, ethyl acrylate resin, butyl acrylate resin, modified acrylic resins (e.g., silicone-modified acrylic resin, vinylchloride-modified acrylic resin, acrylic-urethane resin), vinyl chloride resin, styrene-vinyl acetate copolymer, vinyl chloride-vinyl acetate copolymer, rosin-modified maleic acid resin, phenol resin, epoxy resin, polyester resin, polyester polyurethane resin, polyethylene, polypropylene, polybutadiene, polyvinylidene chloride, ionomer resin, polyurethane resin, silicone resin, ketone resin, ethylene-ethyl acrylate copolymer, xylene resin, polyvinyl butyral resin, polyamide resin, and modified polyphenylene oxide resin. Two or more of these materials can be used in combination.

Materials suitable for the elastic member of the elastic belt include, but are not limited to, elastic rubbers and elastomers, such as butyl rubber, fluorine-based rubber, acrylic rubber, EPDM, NBR, acrylonitrile-butadiene-styrene rubber, natural rubber, isoprene rubber, styrene-butadiene rubber, butadiene rubber, ethylene-propylene rubber, ethylene-propylene terpolymer, chloroprene rubber, chlorosulfonated polyethylene, chlorinated polyethylene, urethane rubber, syndiotactic 1,2-polybutadiene, epichlorohydrin rubber, polysulfide rubber, silicone rubber, polynorbornene rubber, hydrogenated nitrile rubber, and thermoplastic elastomers (e.g., polystyrene type, polyolefin type, polyvinyl chloride type, polyurethane type, polyamide type, polyurea type, polyester type, fluorine-based resin type). Two or more of these materials can be used in combination.

The elastic belt may include a resistivity controlling agent such as carbon black, graphite, a metal powder (e.g., aluminum, nickel), and a conductive metal oxide (e.g., tin oxide, titanium oxide, antimony oxide, indium oxide, potassium titanate, antimony tin composite oxide (ATO), indium tin composite oxide (ITO)). The conductive metal oxides may be covered with insulative fine particles such as barium sulfate, magnesium silicate, and calcium carbonate, for example.

It is desirable that the surface layer of the transfer belt be made of material that can reduce friction resistance of the surface of the belt and does not contaminate the photoconductive drums, or that can reduce adhesion of toner so that cleaning ability and transferability in the secondary transfer process are enhanced. For example, the surface layer may be comprised of one or more of polyurethane, polyester, and an epoxy resin, in which fine particles of one or more of lubricating materials such as fluorine-containing resins, fluorine-containing compounds, carbon fluoride, titanium oxide, and silicon carbide are dispersed. Such lubricating materials can reduce surface energy of the layer and thus increase slidability. The fine particles may have variety of particle diameters. The surface layer may also be a fluorine-containing layer formed by thermally treating a fluorine-containing rubber which can reduce surface energy of the layer.

The elastic belt is manufactured through, but not limited to, a centrifugal casting process in which a material is poured into a cylindrical mold and rotated, a spray painting process in which a liquid paint is sprayed to form a film, a dipping process in which a cylindrical mold is dipped into a solution containing the material and pulled out, a casting process in which the material is injected into an inner mold and an outer mold, and vulcanizing and polishing a compound rolled around a cylindrical mold. To prevent excessive stretch of the elastic belt, a rubber layer may be disposed on a relatively inelastic core resin layer. Alternatively, the core layer may include a stretch resistant material. Any other suitable method can be employed to prevent excessive stretch of the elastic belt.

Preferred materials suitable for the stretch-resistant core layer include, but are not limited to, natural fibers (e.g., cotton, silk), synthetic fibers (e.g., polyester fiber, nylon fiber, acrylic fiber, polyolefin fiber, polyvinyl alcohol fiber, polyvinyl chloride fiber, polyvinylidene chloride fiber, polyurethane fiber, polyacetal fiber, polyfluoroethylene fiber, phenol fiber), inorganic fibers (e.g., carbon fiber, glass fiber, boron fiber), and metal fibers (e.g., iron fiber, copper fiber). Two or more of these materials can be used in combination. These materials are used after being formed into yarn or woven cloth.

The yarn may be comprised of either a single filament or multiple filaments twisted together, such as single twist yarn, plied yarn, and two-folded yarn. Two or more of the above-described materials may be formed into blended yarn. The yarn may be subjected to conductive treatments. The woven cloth may be either stockinette or combined weave, and may be also subjected to conductive treatments.

The manufacturing method of the core layer is not limited to the above. For example, a mold is covered by the woven cloth knitted into a cylindrical shape, and a coating layer is formed thereon. Alternatively, the woven cloth knitted into a cylindrical shape is immersed in liquid rubber and then disposed on one side or both sides of the core layer, or the yarn is wound around a mold or the like at a certain pitch and a coating layer is disposed thereon. The thickness of the elastic layer depends on the stiffness of the elastic layer. However, if it is too thick, the surface of the elastic layer stretches and shrinks significantly, causing a crack in the surface. Furthermore, significant stretch and shrinkage of the surface cause stretch and shrinkage of the image. For this reason, the thickness is less than approximately 1 mm.

The foregoing descriptions pertain to an image forming apparatus using the tandem-type intermediate transfer method. The illustrative embodiments described above may be applied to a direct transfer method in which a looped belt conveys a recording medium and toner images on the photoconductive drums 40 are transferred directly onto the recording medium.

According to the illustrative embodiments, the roller-type transfer member, that is, the primary transfer roller 62 is employed. However, a belt-type primary transfer member may be employed.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

a plurality of image bearing members to bear a toner image on a surface thereof;

a transfer device including a plurality of transfer members and an endless belt formed into a loop and entrained around the transfer members, to transfer the toner images from the plurality of image bearing members onto a surface of the belt so that the toner images are superimposed one atop the other on the belt to form a composite toner image;

a plurality of cleaning devices, each of which including a cleaning blade to clean the surface of the plurality of image bearing members after transfer of the toner images from the image bearing members onto the surface of the belt; and a plurality of heaters disposed inside the loop formed by the belt, each heater disposed between adjacent image bearing members, the belt being interposed between the plurality of heaters and the plurality of image bearing members.

2. The image forming apparatus according to claim 1, wherein each of the plurality of transfer members is disposed facing a respective one of the image bearing members, with the belt interposed between the plurality of transfer members and the plurality of image bearing members.

3. The image forming apparatus according to claim 2, wherein the plurality of transfer members each includes a surface layer made of ionic conductive foam resin.

4. The image forming apparatus according to claim 1, further comprising:

a switch operatively connected to the heaters to detect an internal temperature of the image forming apparatus to turn on and off the heaters.

5. The image forming apparatus according to claim 4, wherein the switch comprises a bimetal thermostat.

6. The image forming apparatus according to claim 4, wherein the switch is disposed substantially at a center of the loop formed by the belt.

7. The image forming apparatus according to claim 1, further comprising:

a plurality of heater retainers to hold the heaters;

a plurality of belt guide members disposed inside the loop formed by the belt to guide the belt; and a fastener to fix each of the heater retainers to a respective one of the belt guide members, wherein the heater retainer and the belt guide member contact each other at the fastener.

8. The image forming apparatus according to claim 7, wherein each heater retainer is a planar metal and/or molded resin member.

9. The image forming apparatus according to claim 7, wherein the fastener is a screw.

10. The image forming apparatus according to claim 7, further comprising a heat insulator disposed between the heater retainer and the belt guide member at the fastener.

11. The image forming apparatus according to claim 1, further comprising:

a cover disposed above each of the heaters inside the loop formed by the belt and between adjacent image bearing members.

12. The image forming apparatus according to claim 11, wherein a center of each cover is disposed substantially over a center of the heater and opposed ends of each cover are equidistant from adjacent image bearing members.

13. The image forming apparatus according to claim 1, further comprising a fan disposed inside the loop formed by the belt to circulate air.

14. An image forming apparatus, comprising:

a first photoconductive drum to bear a first toner image;

a second photoconductive drum to bear a second toner image;

an intermediate transfer belt;

a first transfer roller to transfer the first toner image from the first photoconductive drum onto the intermediate transfer belt;

a second transfer roller to transfer the second toner image from the second photoconductive drum onto the intermediate transfer belt;

a heater disposed inside the intermediate transfer belt; and a cover disposed above the heater and disposed inside the intermediate transfer belt, wherein the cover is disposed between the first transfer roller and the second transfer roller.

15. The image forming apparatus according to claim 14, wherein opposed ends of the cover are equidistant from the first transfer roller and the second transfer roller.

16. The image forming apparatus according to claim 14, further comprising a fan disposed inside the intermediate transfer belt to circulate air.

17. The image forming apparatus according to claim 14, wherein the first transfer roller and the second transfer roller each includes a surface layer made of ionic conductive foam resin.

18. An image forming apparatus, comprising:

a photoconductive drum to bear a toner image;

an intermediate transfer belt;

a transfer roller to transfer the toner image from the photoconductive drum onto the intermediate transfer belt;

a heater disposed below the transfer roller and disposed inside the intermediate transfer belt;

a heater holder to hold the heater; and a frame to support the heater holder.

19. The image forming apparatus according to claim 18, further comprising a screw to fasten the heater holder to the frame.

20. The image forming apparatus according to claim 18, further comprising a heater insulator disposed between the heater holder and the frame.

21. The image forming apparatus according to claim 18, wherein the frame is made of metal.

22. The image forming apparatus according to claim 18, wherein the heater holder is made of metal and/or resin.

* * * * *